US009408424B2

(12) United States Patent
Noh et al.

(10) Patent No.: US 9,408,424 B2
(45) Date of Patent: Aug. 9, 2016

(54) FILTERING FACE-PIECE RESPIRATOR HAVING A FACE SEAL COMPRISING A WATER-VAPOR-BREATHABLE LAYER

(71) Applicant: 3M INNOVATIVE PROPERTIES COMPANY, St. Paul, MN (US)

(72) Inventors: Dong-Sun Noh, Gyeonggi province (KR); Jin-Ho Lee, Seoul (KR); Tae-Sub Kim, Seongnam-si (KR)

(73) Assignee: 3M Innovative Properties Company, St. Paul, MN (US)

( * ) Notice: Subject to any disclaimer, the term of this patent is extended or adjusted under 35 U.S.C. 154(b) by 579 days.

(21) Appl. No.: 13/738,415

(22) Filed: Jan. 10, 2013

(65) Prior Publication Data

US 2014/0190492 A1 Jul. 10, 2014

(51) Int. Cl.
*A41D 13/11* (2006.01)

(52) U.S. Cl.
CPC ..... *A41D 13/1161* (2013.01)

(58) Field of Classification Search
CPC ..... A41D 13/11; A62B 7/10; A62B 23/02; A62B 18/08; A62B 18/025
See application file for complete search history.

(56) References Cited

U.S. PATENT DOCUMENTS 3,802,428 A * 4/1974 Sherman ..... A61M 16/0048 128/200.24
3,810,473 A * 5/1974 Cruz, Jr. ..... A61F 13/00034 106/156.1
3,953,566 A 4/1976 Gore
4,167,185 A 9/1979 Lewis
4,210,709 A 7/1980 Doi
4,408,357 A * 10/1983 Toth ..... A41D 13/1209 2/114
4,539,256 A 9/1985 Shipman
4,588,537 A 5/1986 Klaase
4,595,001 A 6/1986 Potter
4,613,544 A 9/1986 Burleigh
4,665,570 A 5/1987 Davis
4,726,989 A 2/1988 Mrozinski
4,739,755 A 4/1988 White
4,798,850 A 1/1989 Brown
4,848,334 A * 7/1989 Bellm ..... A61M 16/06 128/206.24
4,957,795 A 9/1990 Riedel
5,006,247 A 4/1991 Dennison
5,176,953 A 1/1993 Jacoby
5,419,318 A 5/1995 Tayebi
5,617,849 A 4/1997 Springett
5,673,690 A 10/1997 Tayebi
5,683,794 A 11/1997 Wadsworth (Continued)

FOREIGN PATENT DOCUMENTS

EP 0515986 6/1997
KR 2000-0013984 6/2000

(Continued)

OTHER PUBLICATIONS

International Search Report, PCT/US2014/010593, mailed Apr. 21, 2014, 3 pages.

(Continued)

*Primary Examiner* — Nicholas Woodall
*Assistant Examiner* — Camtu Nguyen
(74) *Attorney, Agent, or Firm* — Kenneth B. Wood

(57) ABSTRACT

Herein is disclosed a shaped filtering face-piece respirator having a face seal that includes a water-vapor-breathable layer.

24 Claims, 3 Drawing Sheets

(56) References Cited

U.S. PATENT DOCUMENTS

| | | | | |
|---|---|---|---|---|
| 5,849,325 | A | 12/1998 | Heinecke | |
| 5,981,038 | A | 11/1999 | Weimer | |
| 6,001,464 | A | 12/1999 | Schultze | |
| 6,072,005 | A | 6/2000 | Kobylivker | |
| 6,106,956 | A | 8/2000 | Heyn | |
| 6,237,596 | B1 | 5/2001 | Bohmfalk | |
| 6,413,070 | B1 | 7/2002 | Meyering | |
| 6,444,302 | B1 | 9/2002 | Srinivas | |
| 6,569,225 | B2 | 5/2003 | Edmundson | |
| 6,783,574 | B1 | 8/2004 | Angadjivand | |
| 6,824,718 | B2 | 11/2004 | Eitzman | |
| 6,854,463 | B2 | 2/2005 | Japuntich | |
| 6,858,290 | B2 * | 2/2005 | Mrozinski | B29C 55/005 424/402 |
| 6,926,961 | B2 * | 8/2005 | Roth | B01D 39/1623 252/62.54 |
| 6,929,853 | B2 | 8/2005 | Forte | |
| 7,086,400 | B2 * | 8/2006 | Shigematsu | A41D 13/11 128/205.25 |
| 7,131,442 | B1 | 11/2006 | Kronzer | |
| 7,338,916 | B2 | 3/2008 | Rollin, Jr. | |
| 7,765,698 | B2 | 8/2010 | Sebastian | |
| 7,858,163 | B2 | 12/2010 | Angadjivand | |
| 7,915,342 | B2 | 3/2011 | Aguirre | |
| 8,029,892 | B2 | 10/2011 | Lacroix | |
| 2003/0228459 | A1 | 12/2003 | Mrozinski | |
| 2005/0079379 | A1 | 4/2005 | Wadsworth | |
| 2006/0144403 | A1 | 7/2006 | Messier | |
| 2006/0289009 | A1 * | 12/2006 | Palomo | A62B 23/025 128/206.19 |
| 2008/0230068 | A1 | 9/2008 | Rudolph | |
| 2009/0151733 | A1 | 6/2009 | Welchel | |
| 2009/0211581 | A1 | 8/2009 | Bansal | |
| 2011/0112458 | A1 | 5/2011 | Holm | |
| 2012/0125341 | A1 | 5/2012 | Gebrewold | |

FOREIGN PATENT DOCUMENTS

| | | |
|---|---|---|
| KR | 2002-0079000 | 10/2002 |
| WO | WO 2010-133268 | 11/2010 |

OTHER PUBLICATIONS

Wente, "Superfine Thermoplastic Fibers", Industrial Engineering Chemistry, Aug. 1956, vol. 48, No. 8, pp. 1342-1346.

* cited by examiner

FILTERING FACE-PIECE RESPIRATOR HAVING A FACE SEAL COMPRISING A WATER-VAPOR-BREATHABLE LAYER

BACKGROUND

Respirators are often worn in the workplace e.g. to minimize the chance of undesired particles entering a wearer's respiratory system.

SUMMARY

In broad summary, herein is disclosed a shaped filtering face-piece respirator having a face seal that comprises a water-vapor-breathable layer. These and other aspects of the invention will be apparent from the detailed description below. In no event, however, should this broad summary be construed to limit the claimable subject matter, whether such subject matter is presented in claims in the application as initially filed or in claims that are amended or otherwise presented in prosecution.

Figure 1:
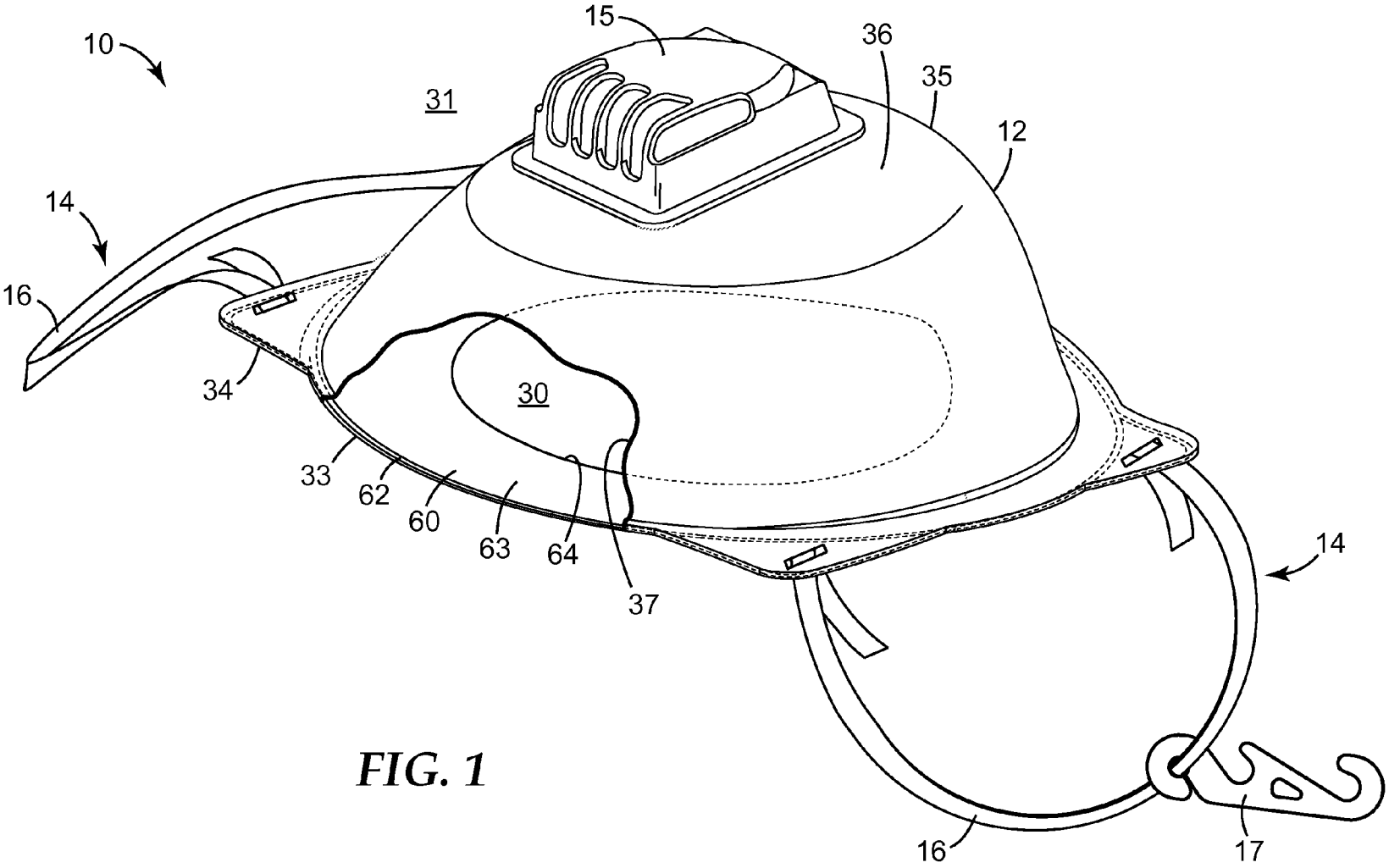
FIG. 1 is a front-side perspective view, in partial cutaway, of an exemplary shaped filtering face-piece respirator as disclosed herein.

Like reference numbers in the various figures indicate like elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "top", bottom", "upper", lower", "under", "over", "up" and "down", and "first" and "second" may be used in this disclosure, it should be understood that those terms are used in their relative sense only unless otherwise noted. As used herein, terms such as "forward" and "front" denote a direction generally away from a wearer's face and terms such as "rearward" and "rear" denote a direction generally toward a wearer's face (when the herein-disclosed respirator is fitted in position on a wearer's face). Terms such as "inward" and "inner" denote a direction away from the perimeter of the respirator, generally toward a central location (e.g., a geometric center) within the interior air space defined by the respirator. Terms such as "outward" and "outer" denote a direction that is away from such a geometric center, e.g. toward and/or past the perimeter of the respirator. As used herein as a modifier to a property or attribute, the term "generally", unless otherwise specifically defined, means that the property or attribute would be readily recognizable by a person of ordinary skill but without requiring absolute precision or a perfect match (e.g., within +/−20% for quantifiable properties). The term "substantially", unless otherwise specifically defined, means to a high degree of approximation (e.g., within +/−10% for quantifiable properties) but again without requiring absolute precision or a perfect match. Terms such as same, equal, uniform, constant, strictly, and the like, are understood to be within the usual tolerances or measuring error applicable to the particular circumstance rather than requiring absolute precision or a perfect match.

DETAILED DESCRIPTION

Glossary

"Conformable" refers to structures that have sufficient flexibility or deformability to be compliant to form contoured, curved, or flat segments in response to forces or pressures from normal use conditions;

"disposable" denotes a respirator that is disposed after an appropriate period of use, rather than the respirator being re-used and/or having a fresh filter cartridge or the like being attached to the used respirator;

"exterior air space" means the ambient atmospheric air space into which exhaled air enters after passing through and beyond the mask body and/or exhalation valve;

"face seal" means a sheet-like structure that extends inwardly from a perimeter of the open end of a mask body of a respirator, that is sufficiently conformable to adjust to the contours of a wearer's face when the respirator is worn by a wearer, and that helps minimize or prevent the entry of particles into an interior air space;

"filtering face-piece respirator" denotes a respirator with a mask body that is designed to filter air that passes through it; by definition there are no separately identifiable filter cartridges that are attached to, molded onto, etc. the mask body to achieve this purpose;

"harness" means a structure or combination of parts that assists in supporting and retaining a mask body on a wearer's face;

"integral" means that the parts in question were made at the same time as a single part and not two separate parts subsequently joined together;

"interior air space" means the space between a mask body and a person's face;

"liquid-water-repellent" when used in reference to a layer means that the layer satisfactorily prevents liquid water (e.g., sweat) from penetrating (e.g., wicking) through the layer;

"mask body" means an air-permeable structure of a respirator, which structure is designed to fit over the nose and mouth of a person and that helps define an interior air space separated from an exterior air space;

"microvoid" means a cavity of a polymeric layer (e.g., film), with the cavity comprising a shortest dimension in the range of about 0.01 to about 20 microns.

"particle" means any particulate contaminant that is desired to be partially or completely excluded from the interior air space of the respirator, and broadly encompasses particles that are solids or semi-solids or aggregates, and particles that are liquid (aerosol) droplets;

"perimeter" means the outer edge of the mask body, which outer edge would be disposed generally proximate to a wearer's face when the respirator is worn by a person;

"shaped" when used in reference to a filtering face-piece respirator and a mask body thereof means that that the mask body of the respirator is permanently formed into a desired face-fitting configuration and generally retains that configuration when not in use, which shaped respirator is by definition distinguished from respirators that are designed to be folded flat when not in use;

"small-molecule" additive means an additive with a molecular weight of 5000 or less that is not covalently bound into polymer chains of a layer (e.g., a polymer film or nonwoven web);

"water-vapor breathable" means a layer that is liquid-water-repellent and that has a moisture-vapor transmission rate (MVTR) of from 400-20000 grams per square meter per 24 hours, when tested at a temperature of 38° C.

Figure 2:
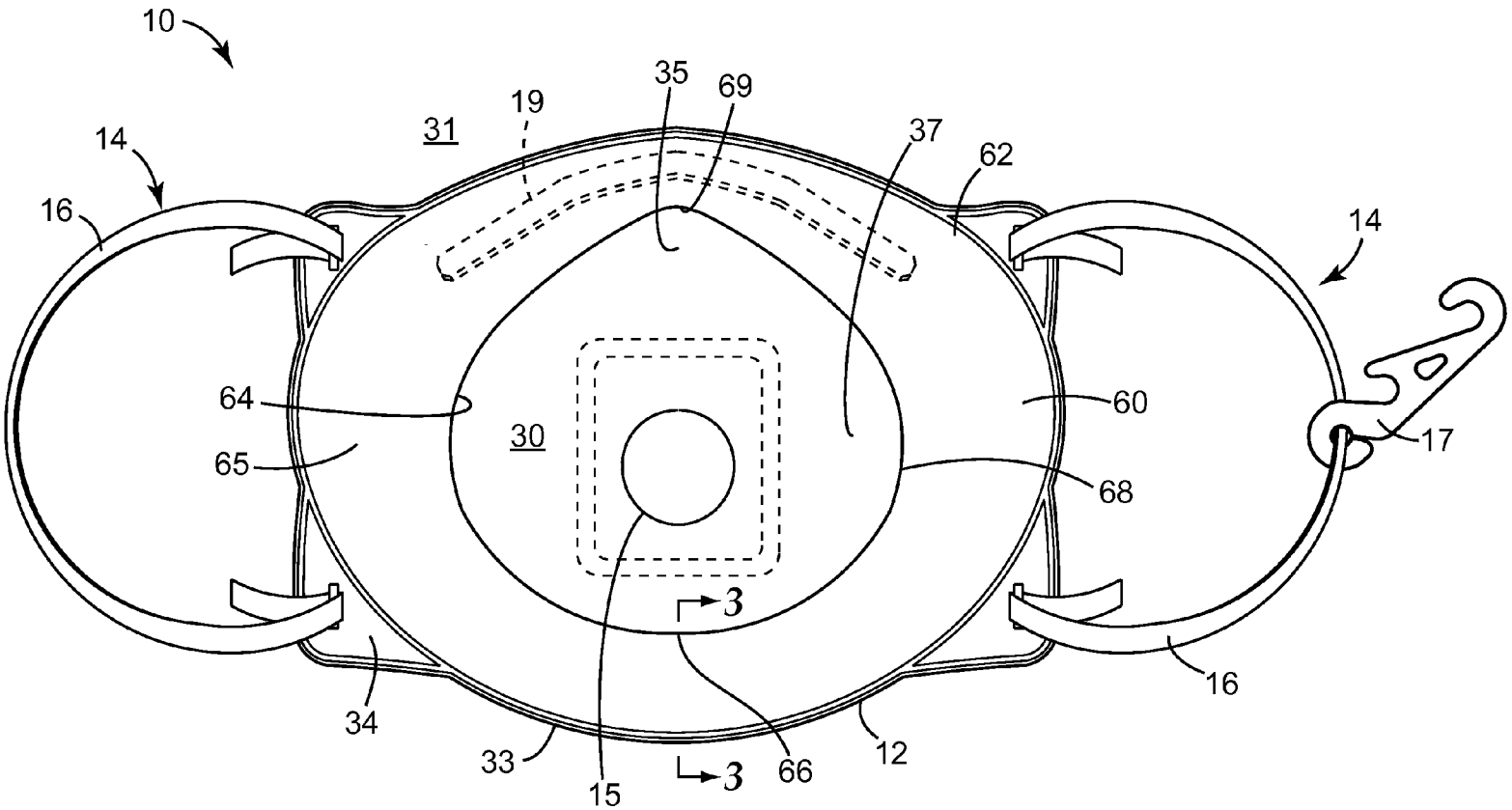
FIG. 2 is rear-side perspective view of the respirator of FIG. 1.

In FIG. 1 is shown an exemplary shaped filtering face-piece respirator 10, in front-side perspective view in partial cutaway to show a portion of face seal 60 of respirator 10. FIG. 2 depicts exemplary respirator 10 in rear-side perspective view (that is, from the open end of respirator 10). Respirator 10 comprises shaped mask body 12 and harness 14, which harness 14 may comprise one or more straps 16 that may be made e.g. from an elastic material. Mask body 12 has a perimeter 33 that is shaped to contact the wearer's face e.g. over the bridge of the nose, across and around the cheeks, and under the chin. In some embodiments, generally all, or substantially all, of perimeter 33 may lie in an imaginary plane, as in the exemplary design of FIGS. 1 and 2. In other embodiments, only a portion of perimeter 33 may lie in such an imaginary plane. Mask body 12 is shaped to form an enclosed interior air space 30 around the nose and mouth of the wearer so as to separate this space from exterior air space 31 e.g. so that any air that enters interior air space 30 from exterior air space 31 must pass through a filtering layer of mask body 12. In many embodiments, mask body 12 may comprise a bulbous portion 35 that protrudes forwardly (that is, in a direction away from the wearer's face) from perimeter 33 of mask body 12. While the shape of bulbous portion 35 is often generally cup-shaped, any suitable shape can be used.

FIG. 2 shows a rear view of face seal 60 in exemplary embodiment. Face seal 60 is provided on the open (rear) side of respirator 10 and can provide a comfortable fit against a wearer's face while also helping to minimize or prevent the entry of particles into interior air space 30. Face seal 60 is thus a sheet-like material that extends inwardly from perimeter 33 of mask body 12 and that is sufficiently conformable to adjust to the contours of a wearer's face when respirator 10 is worn by a wearer, e.g. so as to achieve an air-tight seal. In many embodiments face seal 60 may extend inwardly (e.g. in a direction generally aligned with an imaginary plane defined by mask body perimeter 33) from generally all, or substantially all, portions of perimeter 33 of mask body 12, so that inner edge 64 of face seal 60 provides a perimeter that defines (i.e., surrounds) an opening that is configured to receive and accommodate at least portions of a wearer's chin, cheeks, mouth and nose. It is noted that when respirator 10 is provided to a wearer, face seal 60 may often be aligned with an above-described imaginary plane established by perimeter 33 of mask body 12. However, upon the wearer donning respirator 10, portions of face seal 60 may, in conforming to the wearer's face, deflect slightly forwardly (that is, toward bulbous portion 35 of mask body 12) e.g. so as to maintain slight pressure against the wearer's face so as to maintain the above-mentioned air tight seal. Face seal 60 may remain slightly forwardly deflected even when respirator 10 is e.g. temporarily removed from the wearer's face. (It will also be appreciated that some such slight forward deflection may result if multiple respirators 10 are stacked together for shipping and storage.) It will be understood, however, that face seal 60, being sheet-like as described above, is distinguished from structures with a non-sheet-like shape, e.g. structures that have a generally tubular cross-section (e.g., of the type described in U.S. Pat. No. 4,665,570).

Figure 3:
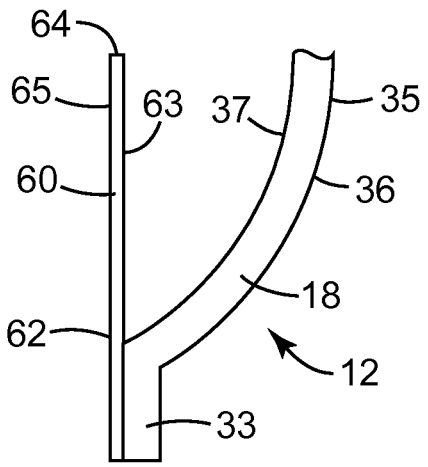
FIG. 3 is a schematic cross-sectional view of a portion of the respirator of FIG. 2, taken along line 3-3 of FIG. 1.

Thus, as shown in further detail in FIG. 3, face seal 60 may comprise an (outer) perimeter 62, which perimeter 62 is connected to (e.g., joined to) perimeter 33 of mask body 12, with face seal 60 extending inwardly to terminate at inner edge 64 of the face seal. In many embodiments, inner edge 64 may comprise chin-accommodating portion 66, cheek-accommodating portion 68, and nose-accommodating portion 69, as shown in exemplary embodiment in FIG. 2, although the particular shape and arrangement of any or all of these portions may be chosen as desired.

In various embodiments, face seal 60 may extend inward from perimeter 33 of mask body 12, a distance from at least about 5, 10, 15, 20 or 25 mm. In further embodiments, face seal 60 may extend inward from perimeter 33 of mask body 12, a distance of at most about 50, 40, 30, 20 or 10 mm. In some embodiments, such a distance may be greater (e.g., by a factor of 1.5, 2, or 3) in cheek-accommodating portion 68, than it is in either chin-accommodating portion 66 or nose-accommodating portion 69. In some embodiments, face seal 60 is not supported by mask body 12, and is not in contact with mask body 12, at any location or portion of face seal 60 except for the above-mentioned face seal perimeter 62 that is connected to (e.g., attached to) mask body perimeter 33. In some embodiments, face seal 60 is not supported by any kind of support frame (comprised e.g. of support members or struts that are in contact with a forward face of face seal 60).

Face seal 60 may be attached to mask body 12, e.g. to perimeter 33 of mask body 12, by any desired attachment mechanism or method. Such methods might include e.g. ultrasonic bonding, thermal bonding, use of an adhesive such as a pressure-sensitive adhesive, hot-melt adhesive, radiation-curable adhesive, use of a mechanical fastener such as one or more staples, clips, and so on, and any combination of such methods. The attachment of face seal 60 to mask body 12 may be performed e.g. substantially continuously around the entirety of perimeter 33 of mask body 12; or it may only be performed at selected locations of perimeter 33. In the illustrated embodiment of FIG. 2, portions of face seal 60 extend outwardly along harness-attachment tabs 34 of mask body 12; however, if desired face seal 60 could be terminated so that portions of it do not extend outwardly along tabs 34 in this manner.

As mentioned, face seal 60 may be conveniently made of a conformal, sheet-like material (which in some embodiments may comprise multiple layers, as discussed in detail later herein). In various embodiments, face seal 60 may be less than about 2, 1, 0.5, 0.2, or 0.1 mm in (total) thickness. In some embodiments, face seal 60 is not integral with mask body 12. That is, in such embodiments face seal 60 is not provided by an extension of mask body 12 that is e.g. curled or rolled inward from the perimeter of the mask body to form a face seal. In further embodiments of this type, face seal 60 may be comprised of layers of different materials than are used in mask body 12 (e.g., face seal 60 may not comprise a filtering layer of the same composition and properties as filtering layer 18 of mask body 12, which filtering layer 18 is discussed in detail later herein). In specific embodiments of this type, face seal 60 may be impermeable to air (as defined herein), in contrast to filtering layer 18 of mask body 12.

The elasticity of face seal 60 may be chosen as desired. In various embodiments, face seal 60 (while still being conformable as described above) may not exhibit any significant elasticity (that is, in various embodiments the elongation at break of face seal 60 may be less than 40, 20, 10, or 5%). In other embodiments, face seal 60 may comprise significant elasticity (as manifested by an elongation at break of e.g. at least 40, 80, or 120%.

A face seal as disclosed herein comprises at least a water-vapor-breathable layer. Such a layer is defined in a first part as exhibiting a moisture-vapor transmission rate (herein abbreviated as MVTR) of 400-20000 grams per square meter per 24 hours, when tested at a temperature of approximately 38° C. in an "upright" configuration (in contrast to an "inverted" test configuration in which liquid water is in direct contact with the tested layer); e.g., when tested in generally similar manner as disclosed in U.S. Pat. No. 5,981,038 to Weimer and in U.S. Patent Application Publication 2011/0112458 (Test Method 1A) to Holm. In various embodiments, a water-vapor-breathable layer of the disclosed face seal may exhibit a moisture-vapor transmission rate of at least about 1000, 2000, 4000, 5000, 8000, 10000, or 12000 grams per square meter per 24 hours when so tested. The inclusion of such a water-vapor-breathable layer in the face seal can provide that, at least in most normal conditions, any sweat that is exuded by the skin of the wearer of the respirator, can be transported as water vapor away from the skin at a rate sufficient to maintain the skin in a satisfactorily dry condition (rather than allowing sweat to collect between the face seal and the skin in an unacceptable manner).

Many substrates (e.g., polymeric film materials, membranes, and the like) may be suitable for use as a water-vapor-breathable layer of the disclosed face seal. Such substrates may be broadly divided into two general categories. The first category includes substrates (e.g., films) that achieve high MVTR by way of including of numerous microvoids (i.e., microscopic cavities of the general size range 0.01-20 microns, although other size cavities may also be present) within the substrate. The second category includes substrates (e.g., non-porous films) that achieve high MVTR by way of comprising hydrophilic portions so that water molecules can permeate (e.g., diffuse) through at least the hydrophilic portions of the substrate, at a sufficient rate to achieve the desired MVTR. These general categories will be addressed in detail later herein (recognizing that some water-vapor-breathable layers may comprise properties of both of these general types).

A water-vapor-breathable layer is further defined in a second part as being liquid-water-repellent. That is, such a layer will not allow liquid water that is impinged onto the layer at atmospheric pressure to unacceptably penetrate through the layer from one major surface to the other by capillary action (wicking). Such a property will be well-recognized by the ordinary artisan (and is described and discussed e.g. in U.S. Pat. No. 5,981,038 to Weimer and U.S. Pat. No. 6,858,290 to Mrozinski). In particular embodiments, a liquid-water-repellent layer may not allow liquid sweat to flow through the layer by capillary action. Such a barrier property may be characterized e.g. by a Sweat Contamination Resistance test of the type disclosed e.g. in U.S. Pat. No. 5,981,038 to Weimer. Thus, in some embodiments a water-vapor-breathable layer as disclosed herein, can achieve a "pass" rating in a Sweat Contamination Resistance test.

A face seal as disclosed herein can conform to a wearer's face so as to prevent unacceptable leakage of airborne particles through a space between the wearer's skin and the face seal. In at least some embodiments, a face seal as disclosed herein can also minimize or prevent the passage of airborne particles through the face seal itself, e.g. by including a layer that is a barrier to airborne particles. Such an airborne-particle barrier layer may be the above-described water-vapor-breathable layer itself, or may be an additional layer that is present in the face seal. However achieved, in such embodiments a face seal may not only allow the desired passage of water vapor and stopping of liquid water, it may also provide a sufficient barrier to the passage of airborne particles that the desired filtration performance of the respirator with which the face seal is used is attained and maintained. Thus, one way to evaluate whether a face seal provides satisfactory barrier properties to airborne particles is to test a respirator comprising the face seal, to determine whether the respirator achieves the desired performance rating (when properly fitted to a wearer's face). In various embodiments, such a respirator, comprising a face seal that includes a water-vapor-breathable layer as disclosed herein, can achieve an N95, N99 or N100 rating according to the NIOSH classification system, when tested in generally similar manner to the procedures described in U.S. Patent Application Publication 2005/0079379 to Wadsworth (paragraphs 0022-0023), and evaluated under NIOSH Standard 42 CFR Part 84 as in effect in August 2003. However, other methods of screening can be done on an airborne-particle barrier layer that is a candidate for use in a face seal, without the layer necessarily having to be incorporated into a face seal of a respirator.

As mentioned, in some embodiments the airborne-particle barrier property of a face seal may be supplied by the water-vapor-breathable layer itself. It will be appreciated that some water-vapor-breathable substrates (e.g., those that do not comprise interconnected microvoids that permit air flow through the substrate from one major surface to another to any significant extent, e.g. non-porous films) may be able to be easily determined to provide adequate barrier properties to airborne particles. For example, substrates that allow little or no airflow therethrough, but that exhibit sufficiently high MVTR, may be judged suitable without further testing. However, other water-vapor-breathable substrates may be screened to determine the degree to which airborne particles of various sizes can or cannot penetrate through the substrate. That is, even such substrates as have microvoids arranged to form connected through-passages that extend from one major surface of the substrate to the other major surface, may have passages that are sufficiently small, sufficiently tortuous, or some combination thereof, that they may still satisfactorily limit the passage of airborne particles through the substrate. One simple way in which such substrates may be screened is by the use of an air-permeability densometer (such as those densometers available from Gurley Precision Instruments, Troy, N.Y.), in which the time is measured for a specified volume of air to be passed under a specified force through a specified area of the substrate (as described e.g. in U.S. Pat. No. 6,858,290 to Mrozinski). If the substrate has a combination of sufficiently low porosity and/or sufficiently small pore sizes that an appropriate densometer time is found, the substrate may be a good candidate for use. In various embodiments, a suitable water-vapor-breathable substrate may exhibit a 100 cc densometer time of at least about 5 seconds, 10 seconds, 20, seconds, 50 seconds, or 100 seconds. In further embodiments, a suitable air-permeable, water-vapor-breathable substrate may exhibit a 100 cc densometer time of at most about 1000 seconds, 500 seconds, 200 seconds, 100 seconds, or 500 seconds. It will be appreciated that for e.g. substrates that substantially lack interconnecting through-passages through the substrate, such a densometer time may be e.g. greater than 1000 seconds, which for the purposes of this discussion will be defined as the cut-off between substrates that are air-permeable and those that are air-impermeable. (For many such air-impermeable substrates, such a densometer time may approach infinity). It will be appreciated that the above-presented densometer time criteria may also be used to judge the suitability of a separate airborne-particle barrier layer, if such a separate layer is used rather than relying on the water-vapor-breathable layer to prevent the passage of airborne particles.

Another way in which a potentially suitable airborne-particle barrier layer (e.g., film) may be identified is by determining Quality Factor, which is a well-known parameter that is often used to characterize the performance of filtration layers for respirators and the like. Such a Quality Factor may be determined e.g. by exposing the substrate to an airstream containing 0.075 μm sodium chloride aerosol droplets and determining what proportion of the aerosol droplets are able to penetrate through the substrate, as discussed e.g. in U.S. Pat. No. 7,858,163 to Angadjivand. In various embodiments, a suitable airborne-particle barrier substrate (which may or may not be a water-vapor-breathable substrate) may exhibit a Quality Factor of at least about 0.4, 0.6, 0.8, or 1.0 $mm^{-1}$ $H_2O$ when exposed to a 0.075 μm sodium chloride aerosol flowing at a 13.8 cm/sec face velocity (or, at whatever velocity at which air can be passed through the substrate, as long as such velocity is commensurate with satisfactory performing of the test). It is recognized in this regard that such a Quality Factor test may not be appropriate for substrates with very little or no through-porosity; however, such a test may not be necessary since many such substrates may be judged by the ordinary artisan to possess adequate particle-stopping properties without the need for Quality Factor testing (e.g., based on one or more of the criteria mentioned above).

Thus in summary, a substrate (e.g., a film of any composition, type or structure) that is suitable to serve as a water-vapor-breathable layer of a face seal will comprise at least the combination of sufficiently high ability to permit the passage of water vapor molecules through the substrate and sufficiently high resistance to the wicking of liquid water through the substrate. In some embodiments, such a substrate may also possess sufficiently high airborne-particle barrier properties as described above. In some other embodiments a separate airborne-particle barrier layer may be included in the face seal. In still other embodiments, the design of the face seal may be such that the ability of the face seal to prevent airborne particles from penetrating through the face seal itself (for example, in cases in which very little surface area of the face seal is exposed to the exterior air space, e.g. in comparison to the surface area of the mask body) may not be an issue, so that no such airborne-particle barrier properties may be needed.

As mentioned above, one general category of substrate that may be suitable for use as a water-vapor-breathable layer, includes films/membranes that comprise numerous microvoids. Such microvoids can provide that, even though the polymeric material that forms the solid "skeleton" of the film may be relatively impermeable to the transmission of water molecules, water molecules can propagate through the film mainly by way of the microvoids. In this regard it is noted that the microvoids may not necessarily need to be connected to each other to form a continuous passage all the way through the film from one major surface to the other major surface, as long as any solid material between adjacent microvoids (and/or at a major surface of the film) is sufficiently thin as to not present an unacceptable barrier to diffusion of water molecules. As defined herein, microvoid means a microscopic cavity with a shortest dimension in the range of 0.01-20 microns, although other size cavities may also be present (noting also that for a cavity that comprises an elongated shape, such a shortest dimension may be measured at any location along the elongate length of the cavity).

As stated above, the microvoids may not necessarily need to be connected to each other to form continuous passages through the film, as long as any solid material between adjacent microvoids is sufficiently thin as to not present an unacceptable barrier to diffusion of water molecules. Thus, in some embodiments such a film may be impermeable to airflow, which is specifically defined herein as meaning that the film exhibits a 100 cc densometer time of over 1000 seconds. However, in other embodiments such a film may permit at least some airflow therethrough, as characterized e.g. by a densometer time of less than (often, substantially less than) 1000 seconds, as discussed above.

Numerous microvoid-containing film substrates are available, and will be referred to herein by the general term of microporous films. In various embodiments these include microporous films made by stretching precursor films (e.g. as described in U.S. Pat. No. 6,444,302 to Srinivas and U.S. Pat. No. 3,953,566 to Gore), particularly precursor films that contain nucleating agents, mineral fillers such as calcium carbonate, and the like (as described e.g. in U.S. Pat. No. 6,072,005 to Kobylivker, U.S. Pat. No. 6,106,956 to Heyn, and U.S. Pat. No. 6,569,225 to Edmundson). Such microporous films may also include those made by solvent phase-inversion processes (as described e.g. in U.S. Pat. No. 6,413,070 to Kelly), those made by thermal phase-inversion processes (as described e.g. in U.S. Pat. No. 4,539,256 to Shipman and U.S. Pat. No. 4,726,989 to Mrozinski), those made by extracting (e.g., leaching) substances from precursor films (as described e.g. in U.S. Pat. No. 4,210,709 to Doi), and so on. In some embodiments, suitable microporous films may be made by a flash-spinning process (e.g. as described in U.S. Pat. No. 7,338,916 to Rollin, Jr.) Combinations of such methods may be used (e.g., a precursor film may both be stretched and have a substance extracted therefrom, as described e.g. in U.S. Pat. No. 5,176,953 to Jacoby). In still other embodiments, a so-called track-etch membrane (film) may be used, as long as the pore size and pore density of the membrane are designed in combination to provide the needed combination of ability to satisfactorily permit passage of water molecules, and to deny the wicking of liquid water therethrough. In some embodiments, a suitable microporous film (or films) may be supplied as part of a multilayer construction (e.g. as described in U.S. Pat. No. 6,929,853 to Forte). Microporous films of these various types are widely available, as exemplified by e.g. certain films available under the trade designation CELGARD from Celgard, Charlotte, N.C., the trade designation EXXAIRE from Tredegar, Richmond, Va., the trade designation APTRA from RKW, Rome, Ga., and the trade designation NUCLEPORE from GE Healthcare/Whatman, Piscataway, N.J. It is emphasized that the above descriptions and listings are exemplary, non-limiting examples of potentially suitable materials.

In some embodiments, the microvoids may be distributed substantially uniformly throughout a cross-section of the film (that is, from one major surface to the other major surface). In other embodiments, a gradient of microvoid sizes may be present across the cross-section of the film, as exemplified e.g. by certain solvent-phase-inversion membranes in which microvoid sizes become progressively smaller across the cross-section of the film (see e.g. U.S. Pat. No. 5,006,247 to Dennison). In some specific embodiments, a film may comprise a first major surface with voids (pores) that are open to the first major side of the film, and a second major surface that comprises a surface skin so as to not comprise voids that are open to the second major side of the film (as exemplified by certain surface-skinned membranes that can be made by solvent phase inversion processes).

Microporous films of any of the above-described types may be made of any suitable material, e.g. a synthetic polymeric material, a naturally-derived polymeric material, or physical blend or copolymer of any suitable polymers. Potentially suitable materials may include e.g. polyamides, polyesters, cellulosic polymers and derivatives, polyurethanes, polysulfones, polycarbonates, acrylic polymers, vinyl polymers, and so on. In some embodiments such microporous films may be made of relatively hydrophobic materials (e.g., polymeric materials such as polypropylene, fluorine-containing polymers, and the like), and/or may be coated with additives, may be surface-treated, and so on, to reduce the surface energy of the material to render it less likely for liquid water to be able to penetrate through the pores of the materials.

As mentioned above, another general category of high-MVTR substrate that may be suitable for use as a water-vapor-breathable layer of a face seal are those film substrates that achieve high MVTR by way of possessing hydrophilic portions in the film so that water molecules can diffuse through at least the hydrophilic portions of the film at a sufficient rate. Such films may thus achieve the first part (high MVTR) of the above-discussed two-part definition of a water-vapor-breathable layer in this manner. It will be understood that many such films (particularly if they lack interconnected microvoids; e.g., are at least substantially non-porous) may be able to satisfactorily prevent liquid water from wicking therethrough and so may be water-repellent as defined herein. It will be further understood that many such films (particularly if they lack interconnected microvoids (e.g., are at least substantially non-porous) may be satisfactorily able to prevent airborne particles from passing therethrough. Thus in some embodiments, such films may be air-impermeable as defined herein.

Hydrophilic portions in the film may be provided by including in the film any suitable polymeric material that comprises a sufficient amount of hydrophilic groups, whether such hydrophilic groups are in the form of e.g. main-chain segments, side chain segments, grafted side chains, and so on, and/or by including hydrophilic additives (whether in the form of particles, polymer chains, small-molecule additives such as hydrophilic plasticizers, waxes, oils, etc.), and so on. Often, such hydrophilic groups may be provided in such a way that they group or cluster together to form the hydrophilic portions of the film.

Examples of suitable materials of this general category include hydrophilic thermoplastic urethanes and hydrophilic thermoplastic polyether-amide block copolymers, as described e.g. in U.S. Pat. No. 5,849,325 to Heinecke and U.S. Pat. No. 4,595,001 to Potter. Other suitable materials may include e.g. hydrophilic polyether-ester block copolymers as described e.g. in U.S. Pat. No. 6,001,464 to Schultze. Still other suitable materials may include polymer films comprising acrylic and/or methacrylic monomers and copolymers, which in particular comprise relatively hydrophilic (meth)acrylic moities (e.g., acrylic acid and so on). Films of this general type are described e.g. in U.S. Pat. No. 8,029,892 to Lacroix (noting that Lacroix also discusses the above-mentioned use of hydrophilic polyols and the like). Films of these various types are widely available, as exemplified by e.g. certain films available under the trade designation ESTANE from Lubrizol, Wickliffe, Ohio, the trade designation PEBAX from Arkema, Colombex, France, the trade designation ARNITEL VT from DSM, Evansville, Ind., and the trade designation HYTREL from DuPont, Wilmington, Del. It is emphasized that the above descriptions and listings are exemplary, non-limiting examples of potentially suitable materials.

Mixtures, copolymers and blends of any such materials and/or additives may be used as desired. The composition and/or amount of such hydrophilic groups, additives, etc., may be adjusted as desired, e.g. to provide the desired MVTR without making the film so hydrophilic that is absorbs such high amounts of water as to become unacceptably susceptible to water-swelling. For example, with polyurethanes, the hydrophilicity may be increased by using polyols (which generally form the so-called soft segments of the resulting polyurethane) that are relatively hydrophilic; e.g. by using a higher percentage of e.g. poly(ethylene glycol) in comparison to e.g. poly(tetramethylene glycol). It is noted that such polyurethanes as comprise sufficient hydrophilic segments or the like to provide enhanced MVTR, must be distinguished from polyurethanes with unspecified compositions (and that may further be stated as being required not to have gas permeability) as are disclosed for example in U.S. Pat. No. 7,086,400 to Shigematsu. In some embodiments, combinations of the first and second general categories of high-MVTR substrates may be used. For example, microvoid-comprising materials (e.g., microporous membranes) can be used in which some or all of the microvoids have been filled with hydrophilic materials, as described e.g. in U.S. Pat. No. 4,613,544 to Burleigh.

In various embodiments, a water-vapor-breathable layer as described herein may comprise a thickness of less than about 1.0, 0.5, 0.2, or 0.1 mm. In various embodiments, a water-vapor-breathable layer as described herein is not an open-cell polymeric foam nor a closed-cell polymeric foam. It will be appreciated that high MVTR films of the first and second general categories as described herein, particularly those of thickness less than e.g. 0.5 mm, may be distinguished from e.g. conventional open-cell polymeric foam substrates (which, by virtue of their open-cell nature, may not necessarily provide liquid-water barrier properties and/or airborne-particle barrier properties, particularly if provided at such a small thickness). It will further be appreciated that high MVTR films of the first and second general categories as described herein, particularly those of such small thickness, may be distinguished from e.g. conventional closed-cell polymeric foam substrates (which, by virtue of their production process and closed-cell nature, may not necessarily be available at such small thickness, and/or may not possess the required permeability to water vapor).

In some embodiments a water-vapor-breathable layer as described herein may serve as a face seal when used by itself (as long as it possesses satisfactory physical strength, conformability, etc. to serve in such a role), with no other layers being present. In other embodiments a water-breathable-layer may be provided as a layer of a multi-layer face seal. In such embodiments, any suitable additional layer or layer may be provided for any purpose, e.g., to enhance the strength or abrasion resistance of the water-vapor-breathable layer, for decorative purposes, to provide a highly skin-compatible layer on the rearward side of the face seal, and so on. As mentioned previously, in some embodiments an additional layer that serves as a barrier to airborne particles may be included in the face seal. In some embodiments, an additional layer might serve as a resilient cushioning layer, which may e.g. improve the comfort of the face seal on the face of the wearer. Any suitable resilient substrate may be used for this purpose, e.g. a non-woven material, an open-cell foam, and so on.

Such an additional layer or layers may be provided so as to be generally or substantially contiguous with the water-vapor breathable layer; or, such a layer or layers may occupy a smaller or larger area than the water-vapor-breathable layer. For example, such a layer might be provided along an inner perimeter region of the face seal, or along an outer border region of the face seal, and/or might be provided discontinuously (e.g., as islands) in various areas of the face seal. Such an additional layer or layers may be provided on either side of the water-vapor-breathable layer. However, it will be appreciated that the additional layer(s) should not unacceptably interfere with the ability the water-vapor-breathable layer to transport water vapor away from the wearer's face. That is, a face seal as disclosed herein will not comprise any additional layer or layers that exhibit an MVTR that is sufficiently low (e.g., less than 400 grams per square meter per 24 hours), and that cover (occlude) such a large amount of the area of the water-vapor-breathable layer, so as to unacceptably reduce the ability of the water-vapor-breathable layer to maintain the skin in a dry condition. Thus, in various embodiments, less than about 40, 20, 10, or 5% of the area of the water-vapor-breathable layer may be covered by a low-MVTR layer (or by the combined area of multiple low-MVTR layers).

By way of a specific example, an additional layer in the form of an imperforate film that is very impermeable to water vapor (e.g., with an MVTR of less than about 1 grams per square meter per 24 hours) and that covers substantially all of the water-vapor-breathable layer, would not be suitable. In contrast, any layer of adequately high MVTR might be suitable (particularly if it only covers a portion of the water-vapor-breathable layer). Suitable additional layers might be provided in the form of e.g. fibrous substrates such as non-woven webs, woven fabrics, knitted fabrics, nettings (e.g., expanded-mesh or fibrillated polymeric substrates), and so on. It will be appreciated that many such fibrous substrates may comprise very open structures and thus may not significantly impact the MVTR achieved by the water-vapor-breathable layer.

In specific embodiments in which an additional layer comprises a woven web, such a web may have any suitable weave pattern (e.g., fiber size, spacing between fibers, etc.), and may be comprised of any suitable natural or synthetic polymer, e.g. polyesters, polyamides, cellulosic polymers and derivatives thereof, acrylic polymers, and so on. In specific embodiments in which an additional layer comprises a non-woven web, such a non-woven web might be a melt-blown web (e.g., a so-called blown-microfiber (BMF) web), a spun-bond web, a spun-laced (e.g., hydroentangled) web, a carded web, an air-laid web, a wet-laid web, and so on. Mixtures of multiple fiber types (e.g., melt-blown fibers along with staple fibers) may be used, as may multiple layers of different fiber types (e.g. so-called SMS laminates that comprise an inner layer of melt-blown fibers sandwiched between two layers of spun-bond fibers), and so on. The fibers of such non-woven webs may be bonded or otherwise arranged so as to form a coherent web by any suitable method, e.g. hydroentangling, needle-punching, thermal bonding, the use of a binder, and so on.

In general, the fibers or strands of such an additional layer may be comprised of any suitable material, e.g. polyolefin, polyamide, polyester, polyurethane, cellulose derivatives, and so on. Naturally-derived fibers (e.g., cellulosics, including regenerated cellulose, poly-lactic acid, etc.) may be present in such a layer. Such an additional layer or layers can be conveniently attached to water-vapor-breathable layer 80 to form a multilayer laminate, which multilayer laminate can then be attached to mask body 12 as discussed earlier herein. The attachment of such an additional layer can be achieved by any suitable method or mechanism, as long as the attachment does not unacceptably interfere with the above-discussed functioning of the water-vapor-breathable layer. Exemplary methods of attachment may include e.g. adhesive bonding, thermal bonding, mechanical attachment and so on. Such attachment may be performed over a portion, generally all, or substantially all, of the area of the water-vapor-breathable layer and the additional layer. In some embodiments, such attachment may comprise point-bonding in selected locations of the layers, as achieved e.g. by thermal point-bonding, by the depositing of adhesive onto selected locations, by the placement of mechanical fasteners at selected locations, etc. If an adhesive (e.g., a pressure sensitive adhesive and/or a hot-melt adhesive) is used, the adhesive composition (as well as the amount of area occupied by the adhesive) may be chosen to ensure that the above-discussed functioning of the water-vapor-breathable layer is satisfactorily maintained.

Figure 4:
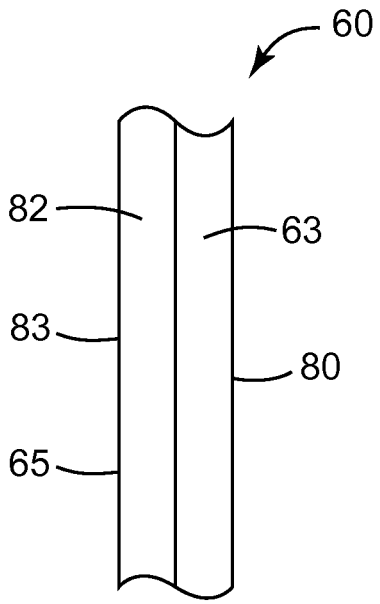
FIG. 4 is a schematic cross-sectional view of a portion of an exemplary face seal as disclosed herein.

In specific embodiments as shown in exemplary illustration in FIG. 4, a face seal 60 may comprise a water-vapor-breathable layer 80 as described above, and may comprise an additional layer 82 on the rearward (e.g., rearmost) side of water-vapor-breathable layer 80, which layer 82 may comprise a rear major surface 83 that may provide the above-mentioned face-contacting surface 65 of face seal 60. In some embodiments, additional layer 82 may be a wicking layer that comprises any suitable non-woven web, woven fabric, knitted fabric, or in general any type of fibrous substrate, that comprises moderate hydrophilicity. By a wicking layer of moderate hydrophilicity is meant that layer 82 is sufficiently hydrophilic to be able to wick liquid water (e.g., liquid sweat that is transferred from the wearer's skin to layer 82) along the major plane of layer 82 so as to spread the liquid water so that it may be more quickly removed as water vapor through water-vapor-breathable layer 80. By moderate hydrophilicity is further meant that layer 82 is hydrophilic enough to promote the desired wicking but is not so hydrophilic as to unacceptably retain (e.g., absorb) liquid water. In other words, a fibrous layer of moderate hydrophilicity should not be comprised so completely of substantially hydrophobic polymers (e.g., polyethylene and the like) that it exhibits little or no water-wicking ability. However, a fibrous layer of moderate hydrophilicity should not be comprised so completely of substantially hydrophilic polymers (e.g., superabsorbent polymers and the like) that it absorbs and retains liquid water too strongly. In other words, a suitable wicking layer should spread any liquid water over a wider area to make it easy to transfer the water away (as water vapor) through the high-MVTR layer, but the wicking layer should not be so water-absorptive that it retains the water near the skin rather than allowing the water to transfer (e.g., by evaporation) into the high-MVTR layer so as to be removed from the skin. Thus, a balance of hydrophobic-hydrophilic properties have been found to be advantageous when such a wicking layer is used between the wearer's face, and the water-vapor-breathable layer. In some embodiments, a face seal may consist only of a water-vapor-breathable layer and a wicking layer (that is located on the rearward side of at least a portion of the water-vapor-breathable layer), with no other layers being present. In other embodiments, other layers may be present in the face seal.

There are several general approaches to providing such a wicking layer, which approaches will be described herein in a non-limiting manner. In one approach, a fibrous wicking layer (e.g., a non-woven web, a woven or knitted fabric, and so on) can be comprised (e.g., generally, substantially, or completely) of fibers with "moderate" hydrophilicity. Materials that might be suitable for such fibers include e.g. certain nylons, polyesters, cellulose acetates, and so on. In another approach, a fibrous wicking layer can be comprised of relatively hydrophobic fibers (e.g., polyethylene, polypropylene, natural rubber, and so on), but with the web incorporating some portion of relatively hydrophilic fibers (e.g., cellulosic fibers, acrylic fibers comprising a significant amount of hydrophilic co-monomer, and so on). That is, any suitable blend of hydrophobic fibers and hydrophilic fibers can be used to arrive at the optimum balance of properties. In a variation of such approaches, a fibrous wicking layer can be comprised of relatively hydrophobic fibers but may further comprise hydrophilic particles of any suitable composition (e.g. hydrocolloids, wood pulp, starch particles, and so on). Conversely, a fibrous wicking layer can be comprised of relatively hydrophilic fibers but may further comprise hydrophobic particles of any suitable composition.

In still another approach, a fibrous wicking layer can be comprised of relatively hydrophobic fibers, but may be treated to be more hydrophilic (e.g., by plasma treatment, corona treatment, by being coated with surfactants or with any other hydrophilic coating, by having hydrophilic surface groups or side-chains grafted thereto, and so on). In still another approach, a fibrous wicking layer can be comprised of relatively hydrophilic fibers, but may be treated to be more hydrophobic (e.g., by being coated with a relatively hydrophobic coating, by having hydrophobic surface groups or side-chains grafted thereto, and so on). In still another approach, a fibrous wicking layer can be comprised of multicomponent fibers that have a balance of hydrophilic and hydrophobic components and regions. And, a wicking layer can be comprised of multiple sub-layers, e.g. of different composition and properties.

It must be emphasized that there are numerous such approaches with no firm dividing line being necessarily present between the various approaches. In general, any combination of hydrophobic and hydrophilic fibers, of hydrophobic and hydrophilic particulate additives, of hydrophobic and hydrophilic additives, coatings, binders, etc., of surface-energy-raising and surface-energy-lowering treatments, and so on, can be used in whatever combination to arrive at a suitable wicking layer with an optimum balance of properties. In some illustrative examples, a fibrous layer comprising polypropylene and/or polyethylene fibers that have been appropriately surface treated (e.g., by plasma or corona), a fibrous layer comprising an appropriate blend of relatively less hydrophilic fibers and relatively more hydrophilic fibers (e.g., a blend of polyester fibers and regenerated cellulose fibers, as exemplified by certain non-woven webs available under the trade designation SONTARA from DuPont, Wilmington, Del.), a fibrous layer comprised substantially of fibers which intrinsically possess suitably moderate hydrophilicity (e.g., certain polyester fibers, nylon fibers or cellulose acetate fibers), a fibrous layer comprising acrylic fibers with an appropriate percentage of hydrophilic monomer units, and a fibrous layer comprising cellulose fibers with an appropriate hydrophobic surface coating or treatment, may be suitable for use as a wicking layer of a face seal.

It is emphasized that the presence of highly hydrophilic components in such a wicking layer (e.g., substrate) is not necessarily precluded; rather, if present they should be present in a sufficiently low quantity (e.g. as a percentage of the total weight of the layer) that they can enhance the wicking ability of the layer, but without causing the layer to exhibit an unacceptably high ability to absorb and retain liquid water. It will be appreciated that in at least some embodiments, it may be advantageous for a material comprising any such hydrophilic component to have a relatively high surface energy to render the surface of the material wettable by liquid water so that the liquid water can be wicked thereby, but not necessarily to have too large of a capacity to absorb the liquid water into the interior of the material. Thus, in various embodiments, any such hydrophilic fibers or particles present in a wicking substrate (e.g., at over 5 wt. % of the total weight of the substrate) may comprise a water retention value as tested in general accordance with ASTM Test Method D2404 of less than about 20%, 10%, or 5% (noting that generally speaking, this test will be applicable to individual fibers rather than being a test of the overall water retention capability of a substrate).

In some embodiments the overall hydrophilicity of a potentially suitable wicking layer (e.g., a fibrous substrate) may be characterized by the Moisture Regain Value of the substrate (that is, how much water is regained when a previously-dried substrate is exposed to water, with reference to ASTM Standard D1909-04, Standard Table of Commercial Moisture Regains, and ASTM Test Method D2654 (Test Methods for Moisture in Textiles)). In various embodiments, such a substrate may comprise a Moisture Regain Value of at least about 1, 2, 3, 4, 5, 6, or 8%. In further embodiments, such a substrate may comprise a Moisture Regain Value of at most about 15, 12, or 8%.

In some embodiments, the overall tendency of a substrate to retain liquid water may be characterized by a liquid water absorbency value obtained generally according to the procedures outlined in ASTM Test Method D-1117 (as described in U.S. Pat. No. 4,957,795 to Riedel). In various embodiments, a substrate that may suitable for a fibrous wicking layer may comprise a liquid water absorbency value of at least about 2, 4, 8, or 16%. In further embodiments, such a substrate may comprise a liquid water absorbency value of at most about 50, 25, 10, or 5% by weight.

In some embodiments, the wicking ability of a substrate may be characterized by a wicking rate test performed generally according to the procedures outlined in INDA Test Procedure 10.3-70 (as described in U.S. Pat. No. 4,957,795 to Reidel). In various embodiments, a substrate that may suitable for a fibrous wicking layer may comprise a wicking rate (when so tested) of at least about 0.2, 0.5, 1.0, or 2.0 cm. In further embodiments, such a substrate may comprise a wicking rate of at most about 10, 5, or 2 cm.

Mask body 12 will comprise at least one filtering layer 18, as shown in exemplary embodiment in FIG. 18. Such a filtering layer can contain one or more layers of filter media suitable for removing particles potentially present in an exterior air space. That is, multiple layers of similar or dissimilar filter media may be used to construct filtering layer 18. A filtering layer 18 may conveniently be generally low in pressure drop, for example, less than about 20 to 30 mm $H_2O$ at a face velocity of 13.8 centimeters per second, to minimize the breathing work of the mask wearer. A filtering layer 18 may be comprised of one or more webs of fine inorganic fibers (such as fiberglass) or polymeric synthetic fibers. Synthetic polymeric fiber webs may include electret charged polymeric microfibers that are produced from processes such as melt-blowing. Polyolefin microfibers formed from polypropylene and that are surface fluorinated and/or electret charged, to produce non-polarized trapped charges, may provide advantageous utility for particle-filtering applications. A layer of filtering layer 18 (e.g. a sub-layer thereof), or, a separate filtering layer 18, may provide a sorbent function for removing unwanted or odorous gas or vapor molecules from the breathing air. Any suitable sorbent (which term broadly encompasses both absorbents and adsorbents) may be used, and may be provided e.g. as a powder or granules that are retained in a filtering layer by adhesives, binders, or fibrous structures. Sorbent materials such as activated carbons, that are chemically treated or not, porous alumna-silica catalyst substrates, and alumna particles are examples of sorbents that may be useful in certain applications.

Essentially any suitable material may be used as a filtering material of layer 18. Webs of melt-blown fibers, such as those taught in Wente, Van A., *Superfine Thermoplastic Fibers,* 48 Indus. Eng. Chem., 1342 et seq. (1956), especially when in a persistent electrically charged (electret) form are especially useful. Such melt-blown fibers may be e.g. microfibers (commonly referred to as BMF for "blown microfiber") that have an effective fiber diameter less than about 20 micrometers (μm), typically about 1 to 12 μm. Particularly preferred may be BMF webs that contain fibers formed from polypropylene, poly(4-methyl-1-pentene), and combinations thereof. Electrically charged fibrillated-film fibers also may be suitable, as well as rosin-wool fibrous webs and webs of glass fibers or solution-blown, or electrostatically sprayed fibers, especially in microfiber form. Nanofiber-containing webs also may be used as a filtering layer.

Electric charge can be imparted to at least some of the fibers of a filtering layer 18 e.g. by contacting the fibers with water as disclosed in U.S. Pat. No. 7,765,698 to Sebastian, U.S. Pat. No. 6,824,718 to Eitzman, and U.S. Pat. No. 6,783,574 to Angadjivand. Electric charge also may be imparted to the fibers by corona charging as disclosed in U.S. Pat. No. 4,588,537 to Klasse or by tribocharging as disclosed in U.S. Pat. No. 4,798,850 to Brown. Any combination of such methods may be used. If desired, additives can be included in the fibers to enhance the ability of the fiber material to attain and maintain electric charge. If desired, fluorine atoms can be disposed at the fiber surfaces in the filter layer to improve filtration performance in an oily mist environment.

In some embodiments, mask body 12 may further comprise additional layers, e.g. one or more of outside or inside cover layers, shaping layers, pre-filter layers, decorative layers, and so on. Any or all such layers may be joined (e.g., ultrasonically bonded, adhesively bonded, thermally bonded, and so on), to the filtering layer, e.g. along selected locations of, or substantially all of, perimeter 33 of mask body 12; or, in selected locations of bulbous portion 35 of mask body 12, or generally throughout all areas of bulbous portion 35 (as long as such bonding does not unacceptably interfere with the ability of air to pass through mask body 12). Any combination of such bonding locations may be used.

In some embodiments, an additional layer that is positioned forward of filtering layer 18 may act as a prefilter to remove large objects (e.g., hair, large dust particles, etc.) that may be present in the exterior air space, and/or may serve to protect filtering layer 18 from abrasion and/or from exposure to excessive contaminants, dirt, and grime, that may be present in the exterior air space. In some embodiments, an additional layer (e.g., an outside cover layer) may be provided as a forwardmost layer of mask body 12. Such a layer may serve e.g. as a decorative layer, and/or may serve one or both of the above pre-filtering or protective functions. In some embodiments, an additional layer (e.g., an inside cover layer) may be provided rearward of filtering layer 18 (toward interior air space 30). Such a layer may protect the rearward side of the filtering layer, may provide a surface that is comfortable when in contact with the wearer's skin, and so on. In some embodiments, a shaping layer or layers may be included in the mask body to assist in creating and maintaining e.g. a cup-shaped configuration, which shaping layer(s) may be provided on either side of the filtering layer, as convenient.

In some embodiments, a liquid-water-repellent layer may be included in mask body 12 (alternatively, filtering layer 18 may be designed to be liquid-water-repellent). Such a property may minimize the chance of liquid water flowing (e.g., by capillary action) through mask body 12 e.g. in the event that liquid water of any composition or sort (e.g., blood, sweat, and so on) is splashed or otherwise impinged onto the surface of mask body 12. It is noted however that a mask body of a filtering face-piece respirator (as described e.g. in U.S. Pat. No. 5,673,690 to Tayebi) in general cannot be assumed to be liquid-water-repellent unless it is so specified or unless the composition of the mask body is described in such terms as would make it clear to the ordinary artisan that such a composition would lead to liquid-water-repellent properties as defined herein.

In some embodiments, a nose clip 19 (made e.g. of aluminum or any suitable malleable metal) can be secured on the inner or outer face of mask body 12, centrally adjacent to its upper edge, to enable the mask to be deformed or shaped in this region to properly fit over a particular wearer's nose, as shown in exemplary embodiment in FIG. 2. In some embodiments, a strip of foam (not shown in any Figure) may be secured in the inner face of mask body 12, to enhance the fit of the mask to the nose and/or the comfort with which the mask rests on the nose. One or more exhalation valves (e.g., exemplary valve 15 as shown in FIGS. 1 and 2) may be attached to mask body 12 to facilitate purging exhaled air from interior air space 30. An exhalation valve may improve wearer comfort allowing warm moist exhaled air to rapidly leave interior air space 30. Essentially any exhalation valve that provides a suitable pressure drop and that can be properly secured to the mask body may be used, and may be attached to the mask body using any suitable technique. In other embodiments, no such exhalation valve may be present. In some embodiments, a support structure may be provided e.g. to assist in maintaining the mask body in a generally cup-shaped configuration. Such a support structure might comprise e.g. one or more support members, frame members, and the like, e.g. as described in U.S. Patent Application Publication 2012/0125341 to Gebrewold. In other embodiments, no such support structure is present.

Any suitable strap or straps, e.g. made of an elastic material, may be used to provide harness 14. Such straps (e.g., straps 16 as depicted herein) may be secured to mask body 12 by any suitable means including adhesive means, bonding means, or mechanical means. A strap 16 could be, for example, ultrasonically welded to the mask body 12 or mechanically attached by other means such as staples. Adjustable buckles may be provided on the harness 14 to allow the straps 16 to be adjusted in length. Fastening or clasping mechanisms also may be attached to the straps 16 to allow the harness 14 to be disassembled when removing the respirator 10 from a person's face and reassembled when donning the respirator 10 onto a person's face. In some embodiments, a single strap (with a first end that is connected to a first lateral edge of the mask body, and a second end that is connected to a second lateral edge of the mask body, in the general manner of each strap 14 shown in the Figures of U.S. Pat. No. 7,131,442 to Kronzer), may be used. In other embodiments, two straps (e.g., an upper strap and a lower strap, again as shown by Kronzer), or more straps, may be used. In some such multiple-strap embodiments, a first strap may have a first end that is connected to a first lateral edge of the mask body, and a second end that is connected to a second lateral edge of the mask body; and a second strap may likewise have a first end that is connected to a first lateral edge of the mask body, and a second end that is connected to a second lateral edge of the mask body (again, as shown by Kronzer). In other multiple-strap embodiments, a first strap may have first and second ends that are both connected to a first lateral edge of the mask body, and a second strap may have first and second ends that are both connected to a second lateral edge of the mask body, as with straps 16 depicted herein in the exemplary embodiment of FIGS. 1 and 2. In such embodiments, it may be convenient to provide a connecting device (e.g., a hook 17 as shown in FIGS. 1 and 2) that can be used to connect portions of the two straps to each other behind the wearer's head, so as to enhance the holding of the respirator securely against the wearer's face. Such arrangements have been found to be particularly helpful when used in combination with the herein-disclosed face seal, to enhance the ability of the face seal to establish and maintain a snug fit against the wearer's face. In specific embodiments, such a connecting device (e.g., hook 17) may be permanently connected to the first strap (meaning that it is not designed to be removed therefrom in ordinary use of respirator 10) and is removably connectable to the second strap, as exemplified by hook 17 of FIGS. 1 and 2. Regardless of the particular design of harness 14, it permits respirator 10 to be donned once by a wearer and then removed; or, to be donned, removed, donned again, removed again, etc., commensurate with the ordinary use of such a respirator. (As mentioned, in at least some embodiments respirator 10 may be disposable, meaning that in ordinary use it is disposed after an appropriate period of use, whether such period of use occurs in one continuous episode, or is intermittent in nature).

Respirator 10 comprising face seal 60 as disclosed herein, can be manufactured using any suitable process. It may be convenient to attach any additional layers to filtering layer 18 while all such layers (e.g., fibrous webs) are in a flat state, and then to deform all of the layers into e.g. a cup-shaped configuration as a multilayer stack. While face seal 60 can be attached at any suitable step in the process, it may be most convenient to form mask body 12 into a desired shape and then to attach face seal 60 thereto, in any suitable manner. Likewise, other components (e.g., harness 14, nose clip 19, exhalation valve 15, etc.) can be attached to mask body 12 using any convenient method, at any convenient time. It is also noted that although in the exemplary embodiments of FIGS. 1 and 2, straps 16 are shown as connected to tabs 34 that extend outwardly beyond perimeter 33 of mask body 12, in general such straps can be attached to any portion or component of mask body 12 (including direct attachment to perimeter 33 or other portion of mask body 12). Moreover, such outwardly-extending tabs (and, in general, any such outwardly-extending projections) may be neglected for the purpose of defining perimeter 33 of mask body 12.

List Of Exemplary Embodiments

Embodiment 1. A shaped filtering face-piece respirator that comprises: a shaped mask body that comprises at least one filtering layer and that comprises a rearward open end with a perimeter; and, a face seal that is connected to the perimeter of the mask body and that extends inwardly from the perimeter of the mask body to terminate at an inner edge of the face seal, wherein the face seal comprises at least one water-vapor-breathable layer that is also liquid-water-repellent.

Embodiment 2. The respirator of embodiment 1, wherein the water-vapor-breathable layer exhibits a moisture-vapor transmission rate of from 1000-20000 grams per square meter per 24 hours, when tested at a temperature of 38° C.

Embodiment 3. The respirator of embodiment 1, wherein the water-vapor-breathable layer exhibits a moisture-vapor transmission rate of from 2000-20000 grams per square meter per 24 hours, when tested at a temperature of 38° C.

Embodiment 4. The respirator of embodiment 1, wherein the water-vapor-breathable layer exhibits a moisture-vapor transmission rate of from 4000-20000 grams per square meter per 24 hours, when tested at a temperature of 38° C.

Embodiment 5. The respirator of embodiment 1, wherein the water-vapor-breathable layer exhibits a moisture-vapor transmission rate of from 8000-20000 grams per square meter per 24 hours, when tested at a temperature of 38° C.

Embodiment 6. The respirator of embodiment 1, wherein the water-vapor-breathable layer comprises an air-permeable substrate.

Embodiment 7. The respirator of embodiment 6, wherein the air-permeable, water-vapor-breathable substrate comprises a 100-cc densometer time of from about 10 seconds to about 100 seconds.

Embodiment 8. The respirator of any of embodiments 1-5, wherein the water-vapor-breathable layer comprises an air-impermeable film.

Embodiment 9. The respirator of any of embodiments 1-8, wherein the water-vapor-breathable layer also serves as an airborne-particle barrier layer.

Embodiment 10. The respirator of any of embodiments 1-9, wherein the water-vapor-breathable layer comprises a porous polymeric substrate that comprises microvoids.

Embodiment 11. The respirator of embodiment 10, wherein the porous polymeric substrate is chosen from the group consisting of: microporous films formed by the stretching of a precursor film along a major plane of the precursor film, microporous films formed by the extracting of substances from a precursor film, microporous films formed by solvent phase-inversion, microporous films formed by thermal phase-inversion, and track-etched membranes.

Embodiment 12. The respirator of any of embodiments 1-11, wherein the water-vapor-breathable layer comprises a polymeric film that comprises hydrophilic portions.

Embodiment 13. The respirator of embodiment 12, wherein polymeric film is a non-porous film in which the hydrophilic portions are provided by hydrophilic groups of main-chain segments, side-chain segments, or grafted side-chains, or any combination thereof.

Embodiment 14. The respirator of embodiment 13, wherein the polymeric film comprises materials chosen from the group consisting of hydrophilic thermoplastic polyurethanes, hydrophilic thermoplastic polyether-amide block copolymers, hydrophilic polyether-ester block copolymer, hydrophilic materials comprising at least some hydrophilic acrylic and/or methacrylic monomer units, and mixtures, copolymers and blends of any of these.

Embodiment 15. The respirator of embodiment 12 wherein the hydrophilic portions of the polymeric film are provided at least in part by one or more hydrophilic additives chosen from the group consisting of hydrophilic particulate additives and hydrophilic small-molecule additives.

Embodiment 16. The respirator of any of embodiments 1-15 wherein the water-vapor-breathable layer is a layer of a multi-layer face-seal.

Embodiment 17. The respirator of embodiment 16 wherein at least one additional layer of the multi-layer face seal is chosen from the group consisting of a non-woven web, a woven or knitted fabric, and a polymeric netting.

Embodiment 18. The respirator of embodiment 16 wherein at least one additional layer of the multi-layer face seal is an airborne-particle barrier layer.

Embodiment 19. The respirator of embodiment 16 wherein at least one additional layer of the multi-layer face seal is a wicking layer that is positioned rearward of the water-vapor-breathable layer, which wicking layer comprises a rearward major surface that serves as a face-contacting surface of the multi-layer face seal.

Embodiment 20. The respirator of embodiment 19 wherein the wicking layer comprises a woven fabric.

Embodiment 21. The respirator of embodiment 19 wherein at least another additional layer of the multi-layer face seal is a resilient cushioning layer that is positioned forward of the wicking layer.

Embodiment 22. The respirator of any of embodiments 1-21, wherein the respirator comprises a first strap with first and second ends that are both connected to a first lateral edge of the mask body, and a second strap with first and second ends that are both connected to a second lateral edge of the mask body, and wherein the respirator further comprises at least one connecting device that is configured to connect a portion of the first strap with a portion of the second strap, behind the head of a wearer.

Embodiment 23. The respirator of embodiment 22 wherein the connecting device is permanently connected to the first strap and is removably connectable to the second strap.

Embodiment 24. The respirator of any of embodiments 1-23, wherein the face seal is not integral with the mask body.

Embodiment 25. The respirator of any of embodiments 1-24, wherein no portion of the face seal is connected with any portion of the mask body other than an outer perimeter of the face seal that is connected to the perimeter of the mask body.

Embodiment 26. The respirator of any of embodiments 1-25, wherein the filtering layer comprises electret fibers.

It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention not merely those representative designs that were chosen to serve as exemplary illustrations. Thus, the scope of the present invention should not be limited to the specific illustrative structures described herein, but rather extends at least to the structures described by the language of the claims, and the equivalents of those structures. To the extent that there is a conflict or discrepancy between this specification as written and the disclosure in any document incorporated by reference herein, this specification as written will control.

What is claimed is:

1. A shaped filtering face-piece respirator that comprises:

a shaped mask body that comprises at least one filtering layer and that comprises a rearward open end with a perimeter;

and, a face seal that is connected to the perimeter of the mask body and that extends inwardly from the perimeter of the mask body to terminate at an inner edge of the face seal, wherein the face seal comprises at least one water-vapor-breathable layer that is also liquid-water-repellent; and wherein the water-vapor-breathable layer exhibits an area and wherein no more than about 20% of the area of the water-vapor-breathable layer is covered by a low-MVTR layer that exhibits an MVTR that is less than 400 grams per square meter per 24 hours when tested at a temperature of 38° C.).

2. The respirator of claim 1, wherein the water-vapor-breathable layer exhibits a moisture-vapor transmission rate of from 1000-20000 grams per square meter per 24 hours, when tested at a temperature of 38° C.

3. The respirator of claim 1, wherein the water-vapor-breathable layer exhibits a moisture-vapor transmission rate of from 5000-20000 grams per square meter per 24 hours, when tested at a temperature of 38° C.

4. The respirator of claim 1, wherein the water-vapor-breathable layer comprises an air-permeable substrate.

5. The respirator of claim 4, wherein the air-permeable, water-vapor-breathable layer comprises a 100-cc densometer time of from about 10 seconds to about 100 seconds.

6. The respirator of claim 1, wherein the water-vapor-breathable layer of the face seal is an air-impermeable film and wherein the face seal is impermeable to air.

7. The respirator of claim 1, wherein the water-vapor-breathable layer also serves as an airborne-particle barrier layer.

8. The respirator of claim 1, wherein the water-vapor-breathable layer comprises a porous polymeric substrate that comprises microvoids.

9. The respirator of claim 8, wherein the porous polymeric substrate is chosen from the group consisting of:

microporous films formed by the stretching of a precursor film along a major plane of the precursor film, microporous films formed by the extracting of substances from a precursor film, microporous films formed by solvent phase-inversion, microporous films formed by thermal phase-inversion, and track-etched membranes.

10. The respirator of claim 1, wherein the water-vapor-breathable layer comprises a polymeric film that comprises hydrophilic portions.

11. The respirator of claim 10, wherein polymeric film is a non-porous film in which the hydrophilic portions are provided by hydrophilic groups of main-chain segments, side-chain segments, or grafted side-chains, or any combination thereof.

12. The respirator of claim 11, wherein the polymeric film comprises materials chosen from the group consisting of hydrophilic thermoplastic polyurethanes, hydrophilic thermoplastic polyether-amide block copolymers, hydrophilic polyether-ester block copolymer, hydrophilic materials comprising at least some hydrophilic acrylic and/or methacrylic monomer units, and mixtures, copolymers and blends of any of these.

13. The respirator of claim 10 wherein the hydrophilic portions of the polymeric film are provided at least in part by one or more hydrophilic additives chosen from the group consisting of hydrophilic particulate additives and hydrophilic small-molecule additives.

14. The respirator of claim 1 wherein the water-vapor-breathable layer is a layer of a multi-layer face-seal.

15. The respirator of claim 14 wherein at least one additional layer of the multi-layer face seal is chosen from the group consisting of a non-woven web, a woven or knitted fabric, and a polymeric netting.

16. The respirator of claim 14 wherein at least one additional layer of the multi-layer face seal is an airborne-particle barrier layer.

17. The respirator of claim 14 wherein at least one additional layer of the multi-layer face seal is a wicking layer that is positioned rearward of the water-vapor-breathable layer, which wicking layer comprises a rearward major surface that serves as a face-contacting surface of the multi-layer face seal.

18. The respirator of claim 1, wherein the face seal is attached to the mask body by an ultrasonic bond that extends substantially continuously around the entirety of the perimeter of the mask body.

19. The respirator of claim 1 wherein the at least one filtering layer comprises electret fibers.

20. The shaped filtering face-piece respirator of claim 1, wherein the shaped filtering face-piece respirator comprises a first strap with first and second ends that are both connected to a first lateral edge of the shaped mask body, and a second strap with first and second ends that are both connected to a second lateral edge of the shaped mask body, and wherein the shaped filtering face-piece respirator further comprises at least one connecting device that is configured to connect a portion of the first strap with a portion of the second strap, behind the head of a wearer.

21. The respirator of claim 20 wherein the connecting device is permanently connected to the first strap and is removably connectable to the second strap.

22. The respirator of claim 1, wherein the face seal is not integral with the mask body.

23. The respirator of claim 1, wherein no portion of the face seal is connected with any portion of the mask body other than an outer perimeter of the face seal that is connected to the perimeter of the mask body.

24. The respirator of claim 1, wherein the face seal exhibits an elongation at break of at least 40%.

* * * * *